US012318647B2

(12) United States Patent
Golamb

(10) Patent No.: US 12,318,647 B2
(45) **Date of Patent: *Jun. 3, 2025**

(54) EXERCISE DEVICE

(71) Applicant: Edward Lamar Golamb, Mesa, AZ (US)

(72) Inventor: Edward Lamar Golamb, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/772,591

(22) Filed: Jul. 15, 2024

(65) Prior Publication Data

US 2024/0366987 A1 Nov. 7, 2024

Related U.S. Application Data

(63) Continuation of application No. 17/741,382, filed on May 10, 2022, now Pat. No. 12,036,433, which is a continuation-in-part of application No. 16/825,083, filed on Mar. 20, 2020, now Pat. No. 11,369,829, which is a continuation-in-part of application No. 29/695,287, filed on Jun. 18, 2019, now abandoned.

(60) Provisional application No. 62/874,616, filed on Jul. 16, 2019.

(51) Int. Cl.

| | |
|---|---|
| ***A63B 15/00*** | (2006.01) |
| ***A63B 21/06*** | (2006.01) |
| ***A63B 21/072*** | (2006.01) |

(52) U.S. Cl.

CPC ..... *A63B 15/00* (2013.01); *A63B 21/0615* (2013.01); *A63B 21/072* (2013.01)

(58) Field of Classification Search

CPC . A63B 21/0004; A63B 21/06; A63B 21/0601; A63B 21/0608; A63B 21/0615; A63B 21/0617; A63B 21/08; A63B 21/22; A63B 21/222; A63B 21/40; A63B 21/4023; A63B 21/4043; A63B 21/4047; A63B 21/4049

See application file for complete search history.

(56) References Cited

U.S. PATENT DOCUMENTS

| | | | | |
|---|---|---|---|---|
| 1,973,593 A * | 9/1934 | Willner | ..... | A63B 21/4035 482/92 |
| 5,496,240 A * | 3/1996 | Damm | ..... | A63B 21/072 482/93 |
| 5,759,139 A * | 6/1998 | Wright | ..... | A63B 21/045 482/121 |

(Continued)

*Primary Examiner* — Zachary T Moore

(74) *Attorney, Agent, or Firm* — Invention To Patent Services; Alex Hobson

(57) ABSTRACT

An exercise device is configured to detachably attached to weight plates and receive a pole that extends to a user end to enable movement of the pole to perform a variety of exercises. The exercise device couples to exercise plates with the shaft of the Y-shaped yoke extending through a plate aperture. A plate pin extends through a plate aperture in a weight plate and is coupled with the Y-shaped yoke. The Y-shaped yoke has a first arm and a second arm that receives a pivot pin therethrough. A pole extends into the shroud of the pivotable tubular receiver and a pole lock secures the pole within the shroud. The pole can then be moved up and down, or pivoted about the pivot pin through the Y-shaped yoke and also rotated within the plate aperture to provide a wide range of motion.

18 Claims, 14 Drawing Sheets

(56) References Cited

U.S. PATENT DOCUMENTS

| | | | | |
|---|---|---|---|---|
| 5,827,157 | A * | 10/1998 | Lee | A63B 21/06 482/93 |
| 8,177,692 | B2 * | 5/2012 | Deppen | A63B 21/0728 434/226 |
| 8,974,354 | B1 * | 3/2015 | Nelson | A63B 21/08 482/94 |
| 9,289,646 | B2 * | 3/2016 | Tully | A63B 23/03525 |
| 9,808,663 | B2 * | 11/2017 | Chen | A63B 21/4049 |
| 2018/0280753 | A1 * | 10/2018 | Krull | A63B 21/025 |
| 2019/0060698 | A1 * | 2/2019 | Sarazen | A63B 21/0004 |

* cited by examiner

EXERCISE DEVICE

CROSS REFERENCE TO REPLACED APPLICATION

This application is a continuation of U.S. patent application Ser. No. 17/741,382, filed on May 10, 2022 and now issued as U.S. Pat. No. 12,036,433 on Jul. 16, 2024, which is a continuation in part of U.S. patent application Ser. No. 16/285,083, filed on Mar. 20, 2020 and issued as U.S. Pat. No. 11,369,829 on Jun. 28, 2022, which claims the benefit of priority to U.S. provisional patent application No. 62/874,616, filed on Jul. 16, 2019, and this application is a continuation in part of U.S. Design patent application Ser. No. 29/695,287, filed on Jun. 18, 2019 and now abandoned; the entirety of all listed prior applications are hereby incorporated by reference herein.

BACKGROUND OF THE INVENTION

Field of the Invention

The invention relates to an exercise device that is configured to detachably attached to weight plates and receive a pole that extends to a user end to enable movement of the pole to exercise.

Background

Exercise is an important part of many people's lives and there are a wide variety of equipment options for aiding in exercise. Bending, stretching and lifting are all important aspects of many exercise routines. Many people prefer or require a support while exercising.

SUMMARY OF THE INVENTION

The invention is directed to an exercise device that is configured to detachably attached to weight plates and receive a pole that extends to a user end to enable movement of the pole to perform a variety of exercises. The exercise device couples to exercise plates or a single plate with the shaft of the Y-shaped yoke extending through a plate aperture. A plate pin extends through a base washer and the base end head of the plate pin is retained by the base washer. A recessed area of the base washer is configured to receive and retain the base end head of the plate pin so that the base washer can extend flush with ground surface. A protrusion from the plate pin detachably attached with the receiver of the shaft of the Y-shaped yoke. The plate pin extends into the plate extension aperture configured with the shaft of the Y-shaped yoke. The Y-shaped yoke has a first arm and a second arm that receives a pivot pin therethrough which also extends through the yoke connector aperture of the pivotable tubular receiver. A pole extends into the shroud of the pivotable tubular receiver and a pole lock secures the pole within the shroud. The pole can then be moved up and down, or pivoted about the pivot pin through the Y-shaped yoke and also rotated within the plate aperture to provide a wide range of motion.

Some weight plates may have a larger plate aperture than other weight plates and a weight plate reducer may be configured to extend over the shaft of the Y-shaped yoke to provide a tighter fit with larger plate apertures. The weight plate reducer may be a cylindrical body having a weight plate reducer conduit for receiving the shaft of the Y-shaped yoke.

The pivotable tubular receiver is coupled between the Y-shaped yoke and a pole that extends from the pivotable tubular receiver. The pivotable tubular receiver extends from a pole end to a yoke end and may be an integral unit being made, such as by molding from single piece of material. An exemplary pivotable tubular receiver has a first tube portion that is configured proximal a user and a second tube portion configured proximal the Y-shaped yoke. The shroud is configured between the first tube portion and second tube portion of the pivotable tubular receiver. The shroud may be larger in diameter than the first and/or second tube portions and sized to accommodate the pole lock, such as a clamp that is coupled to the pole within the shroud. The pole lock is larger in diameter than the first tube conduit, or conduit in the first tube portion for receiving the pole therethrough. This creates an interference fit that prevents the pole from being pulled out from the pivotable tubular receiver. The pole may extend through the shroud and into a second tube conduit in the second tube portion. This retention of the insert end of the pole in the second tube portion will ensure that the pole is aligned within the shroud between the first tube portion and second tube portion. This increases the stability of the connection with the pole.

The pivotable tubular receiver is coupled to the Y-shaped yoke by a pivot pin, such as a shoulder bolt, that extends from a pivot pin aperture in the first arm of the Y-shaped yoke, through the yoke connector aperture in the yoke connector of the pivotable tubular receiver, and then through the pivot pin aperture of the second arm. The pivot pin may be secured in position by a pivot pin nut and the yoke arm may have a recess, such as polygonal recess configured to receive the nut, to prevent the pivot pin nut from rotating.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
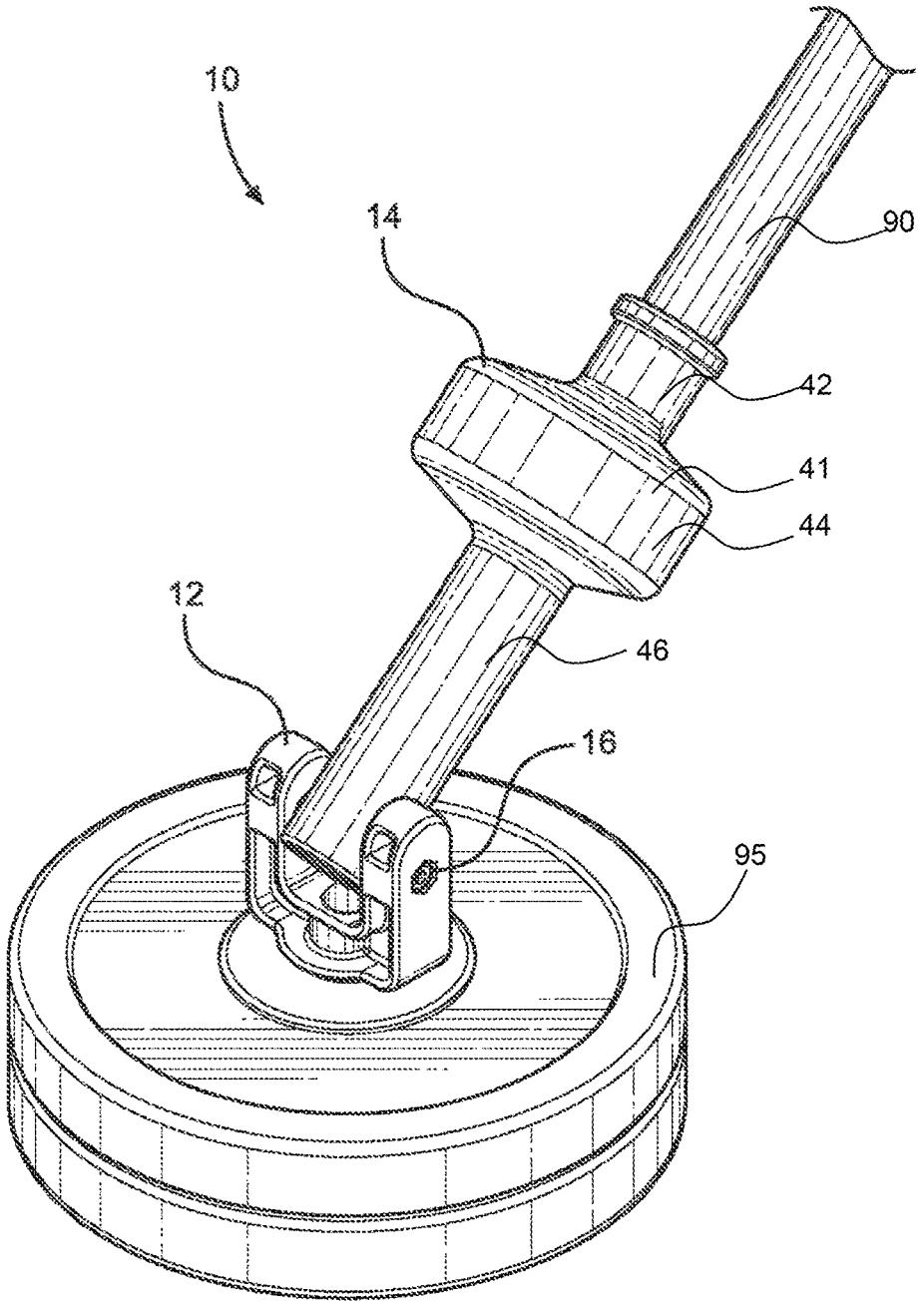
FIG. 1 shows a front perspective view an exemplary exercise device.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
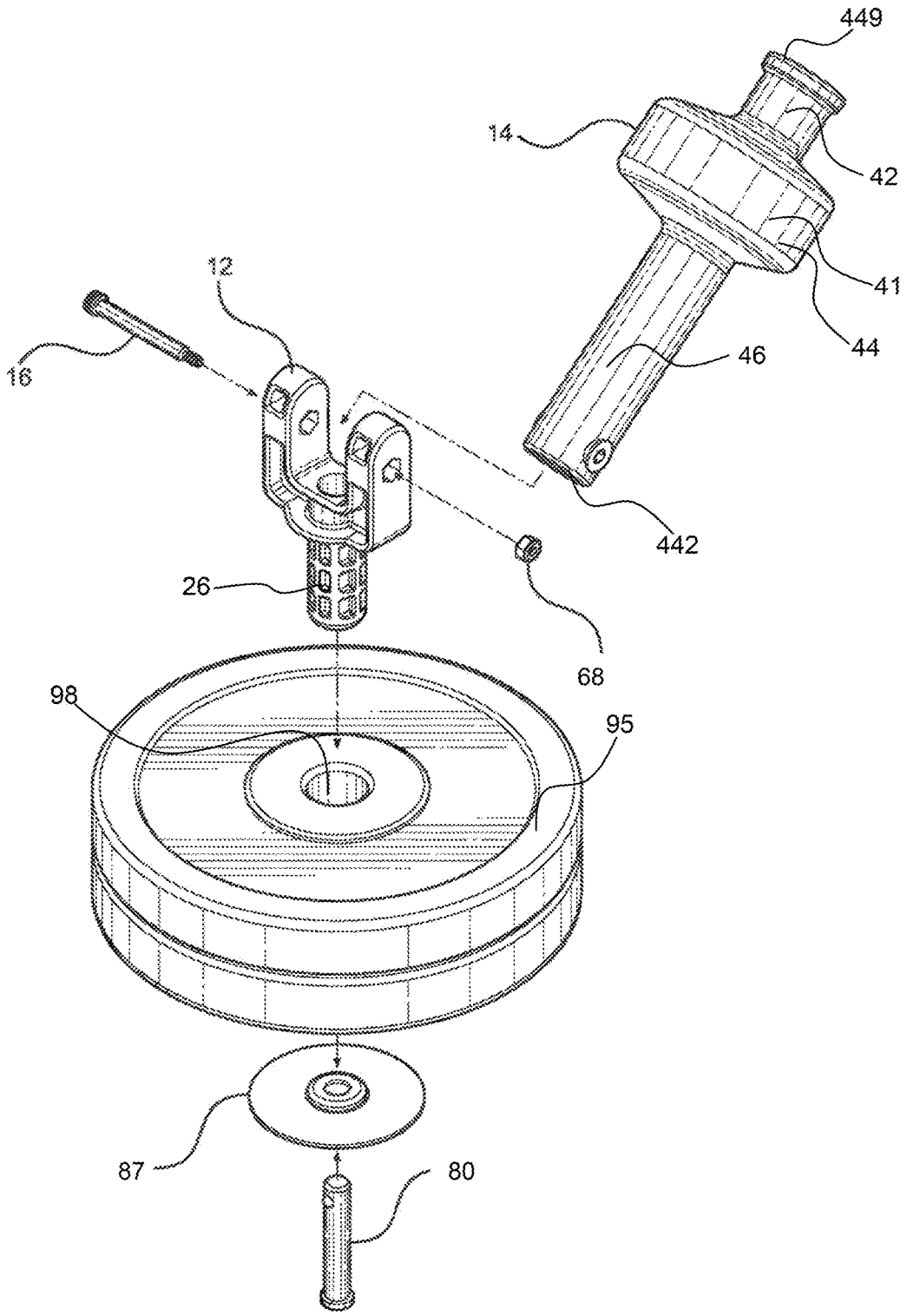
FIG. 2 shows an assembly view of the exercise device shown in FIG. 1
Figure 3:
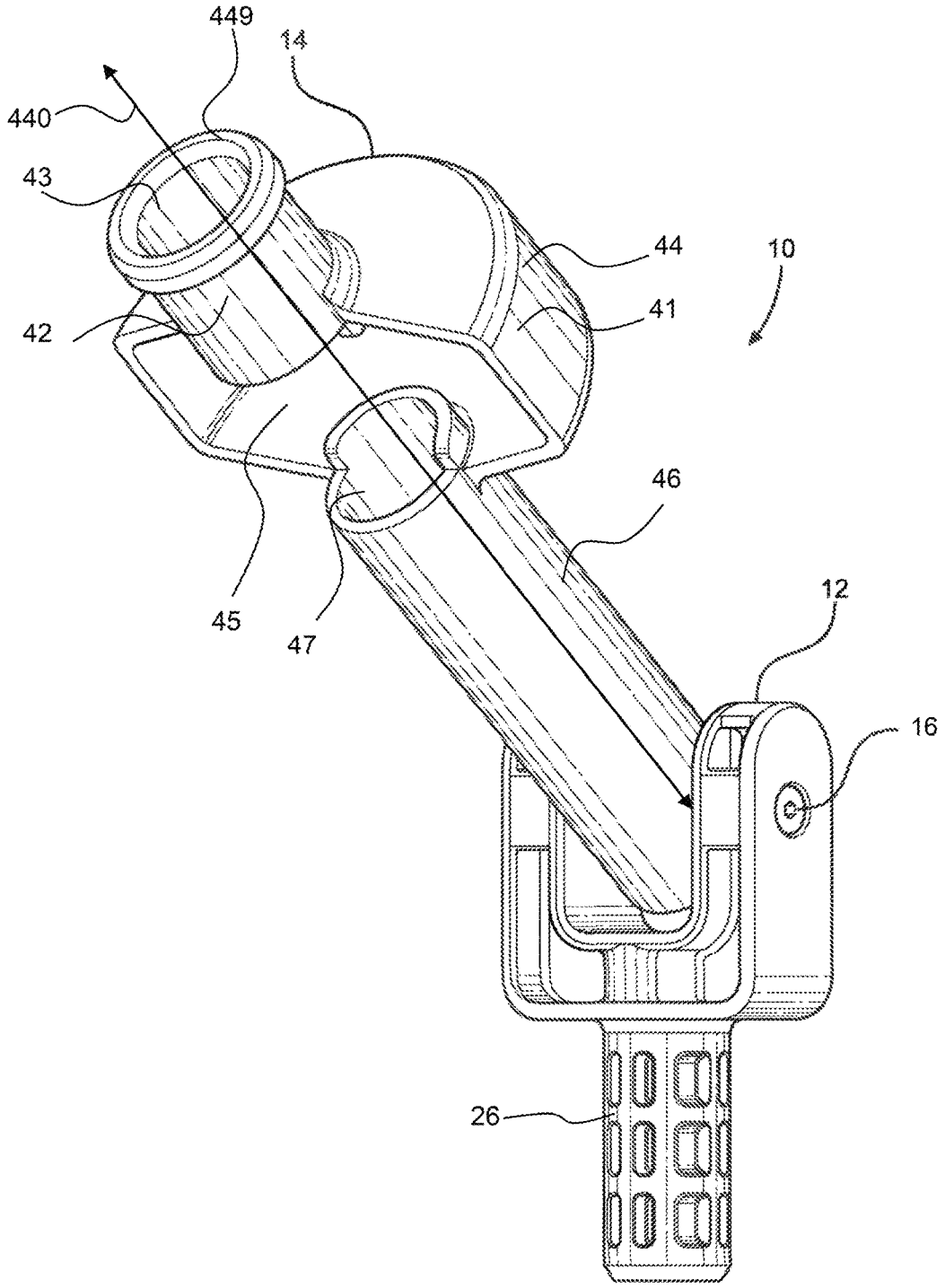
FIG. 3 shows a rear perspective view of the exercise device shown in FIG. 1.
Figure 4:
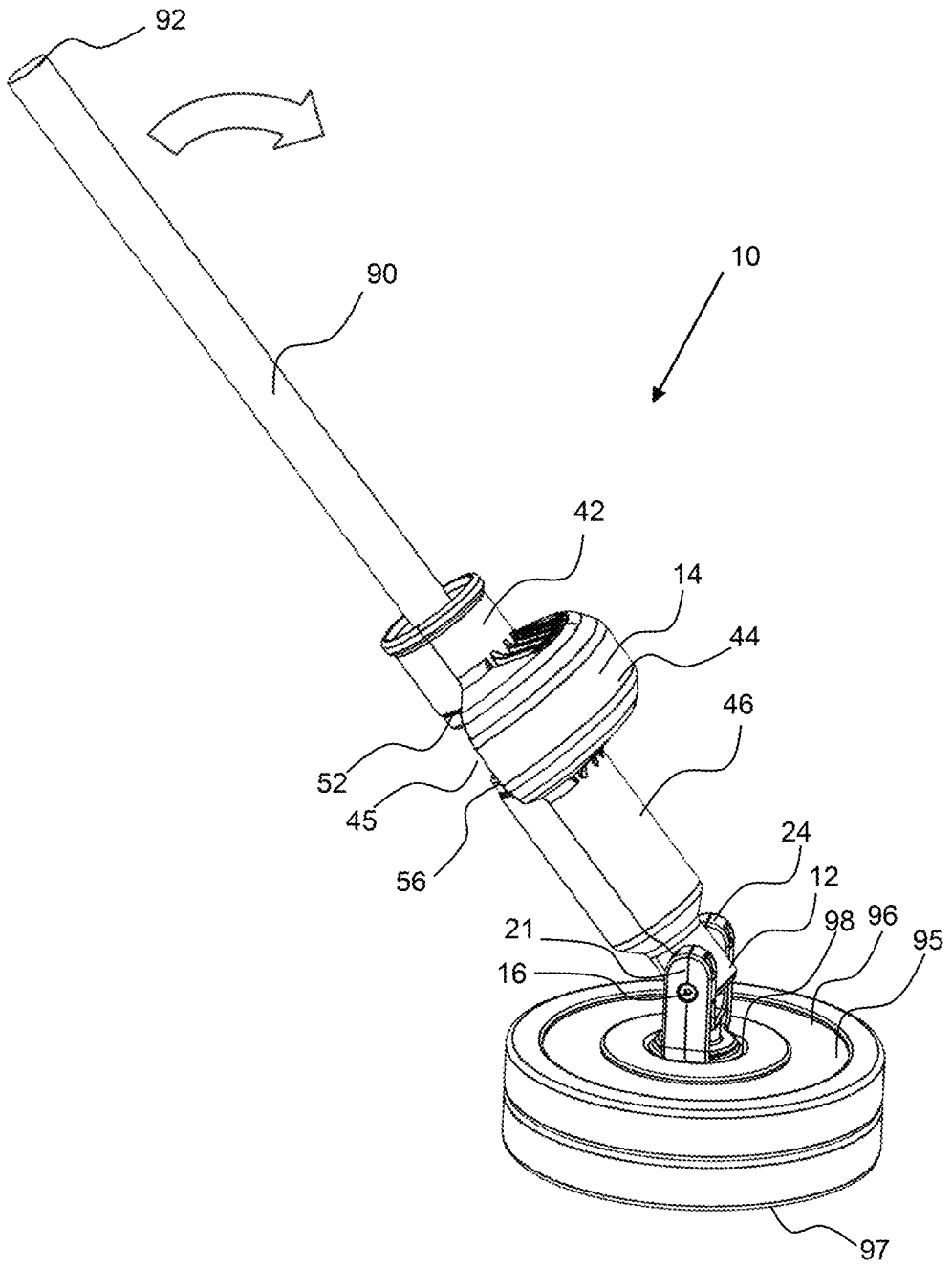
FIG. 4 shows a perspective view of an exemplary exercise device having a y-shaped yoke detachably attached to weight plates and a pivotal tubular receiver pivotably coupled to the y-shaped yoke and having a pole detachably attached thereto.

Referring now to FIGS. 1 to 3, an exercise device 10 includes a Y-shaped yoke 12 joined to a pivotal tubular receiver 14 with a pivot pin 16, such as a shoulder bolt retained by a pivot pin nut 68. A plate pin 80 joins a base washer 87 to the Y-shaped yoke 12. An exercise device includes a Y-shaped yoke joined to a pivotal tubular receiver with a shoulder bolt and nut, such as a locking nut. A plate pin 80 joins a base washer 87 to the Y-shaped yoke 12. The plate pin extends through the base washer 87 and up through a plate aperture 98 in weights plates 95 to provide a stabilizing support foundation while performing exercise. The pivotable tubular receiver 14 extends a length along a length axis 440, from a pole end 449 to a yoke end 442 and may be an integral unit. As best shown in FIG. 3, the first tube portion 42 has a first tube conduit 43 and the second tube portion 46 and a second tube conduit 47, which may have the same diameter, inner diameter as the first tube conduit. The receiver connector or shroud 41 has a receiver gap 45 to enable a pole lock, to be configured around a pole that extends through the first pole conduit, through the shroud to the second pole conduit. In inner diameter of the shroud is much larger than the inner diameter of the first tube conduit or second tube conduit, for this purpose and may be about twice as large or more, about three times as large or more, about five times as large or more and any range between and including the values provided. The receiver gap of the shroud or receiver connector may extend about 90 degrees or more about the perimeter or more, about 120 degrees or more, about 180 degrees or more and any range between and including the values provided. Put another way, the shroud may extend about 270 degrees or less, about 220 degrees or less about 180 degrees or less about 120 degrees or less and any range between and including the values provided.

In some embodiments, the combination of the plate pin 80 and base washer 87 rest on the floor. Standard barbell weight plates can be lowered down over the plate pin 80 and onto the base washer 87. The base washer 87 is designed to self-align to the weight plates, so the plate pin 80 passes up through the plate aperture 98 of the weight plate. The Y-shaped yoke 12 is then pushed down on the plate pin 80 and is transiently held in place by the plate pin protrusion 86 secured against a ball receiver of the Y-shape yoke designed for this purpose. The Y-shaped yoke 12 may rotate about the plate pin. The connection of the receiver to the y-shaped yoke 12 allows the pivotal tubular receiver to rotate circumferentially with the Y-shaped yoke about the plate pin. As the Y-shaped yoke 12 and the pivotal tubular receiver 14 are bolted together, the exercise device 10 provides a circular motion, a vertical or lateral motion of any combination, which in a weighted scenario aids in the performance of exercises.

Turning to these components in more detail, the pivotal tubular receiver 14 further comprises a shroud 41 that forms a receiver connector 44 connecting a first tube portion 42 and a second tube portion 46 into one integral unit. The first tube portion of the pivotal tubular receiver 14 accepts a standard configuration barbell or pole 90. A receiver gap 45 between the first tube portion 42 and the second tube portion 46 is configured to house and retain the barbell with a pole lock or locking mechanism that secures the barbell in place while it is used for exercise. The shroud is designed to center and self-align the locking mechanism in place, keeping it from inadvertently unlocking or otherwise releasing the barbell from its locked position, but still allowing it to rotate freely as required.

Figure 5:
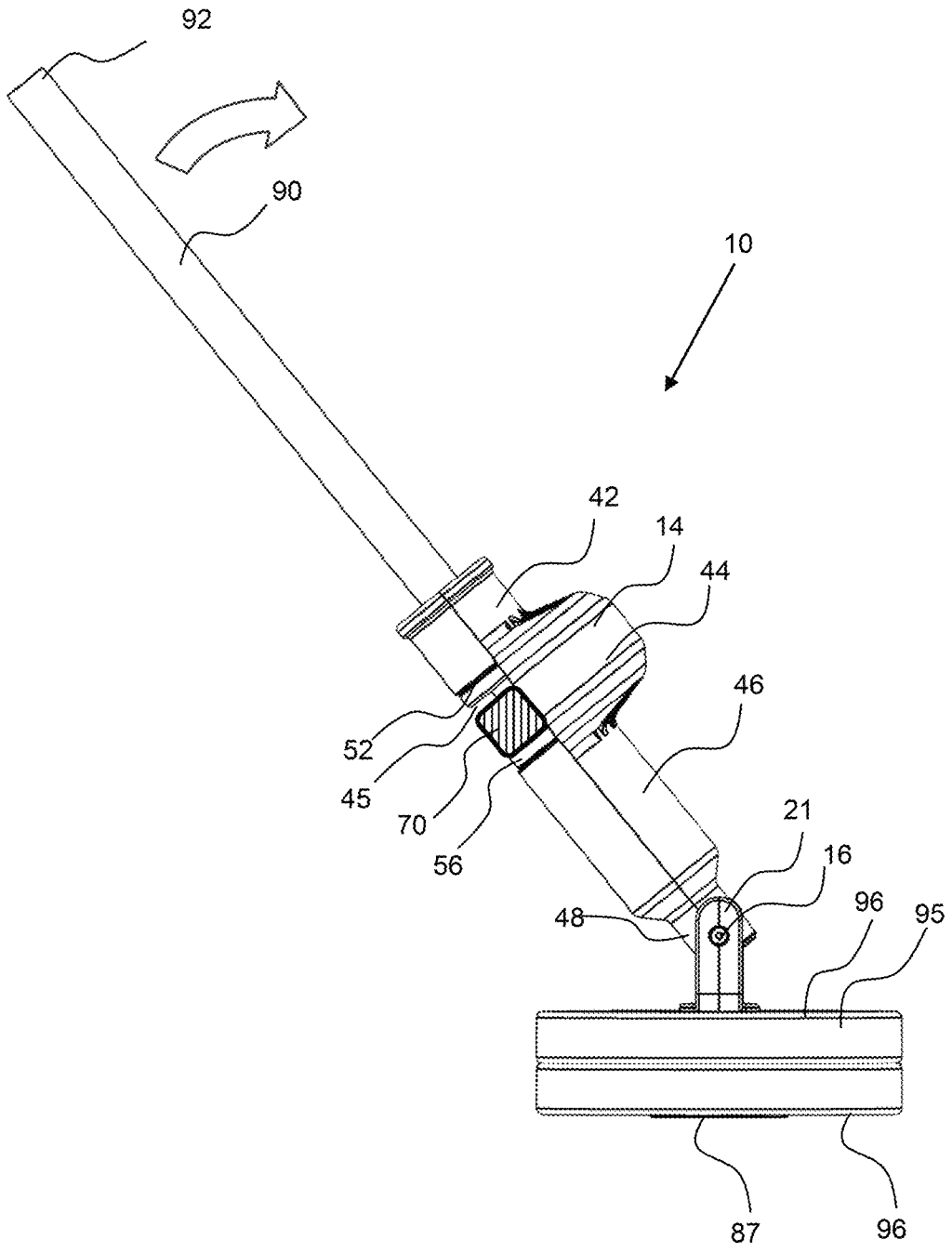
FIG. 5 shows a side view of the exercise device shown in FIG. 4, and a pole lock retained around the pole and also secured in the receiver gap between the first tube portion and the second tube portion of the pivotal tubular receiver.
Figure 6:
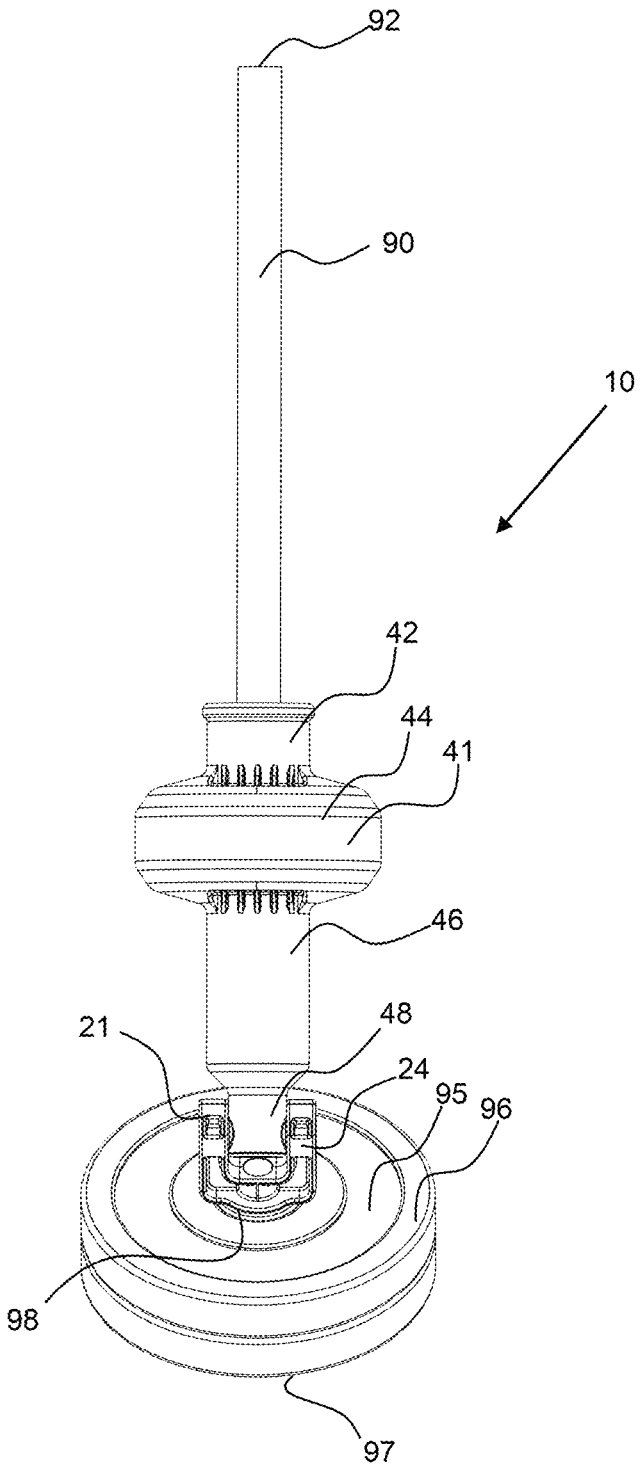
FIG. 6 shows a front view of the exercise device shown in FIG. 4.
Figure 7:
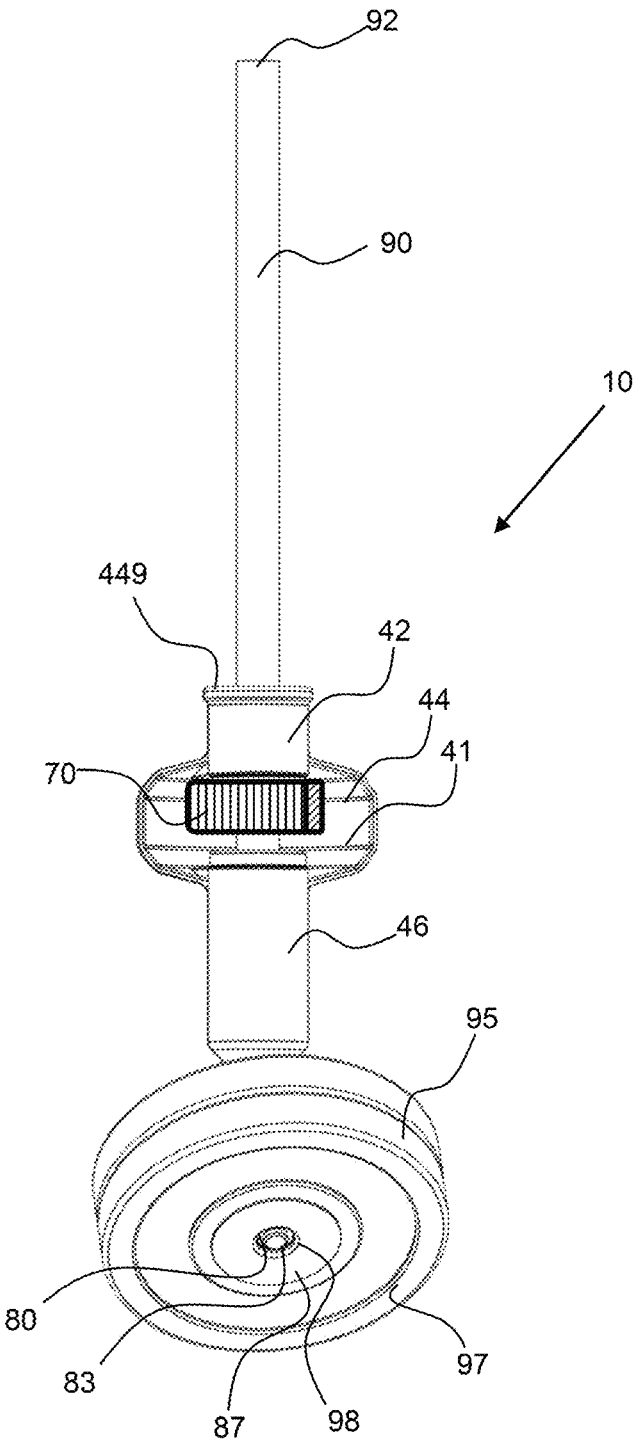
FIG. 7 shows a back perspective view of the exercise device shown in FIG. 4 with the base washer secured to the weight plates by the plate pin and plate pin head.
Figure 8:
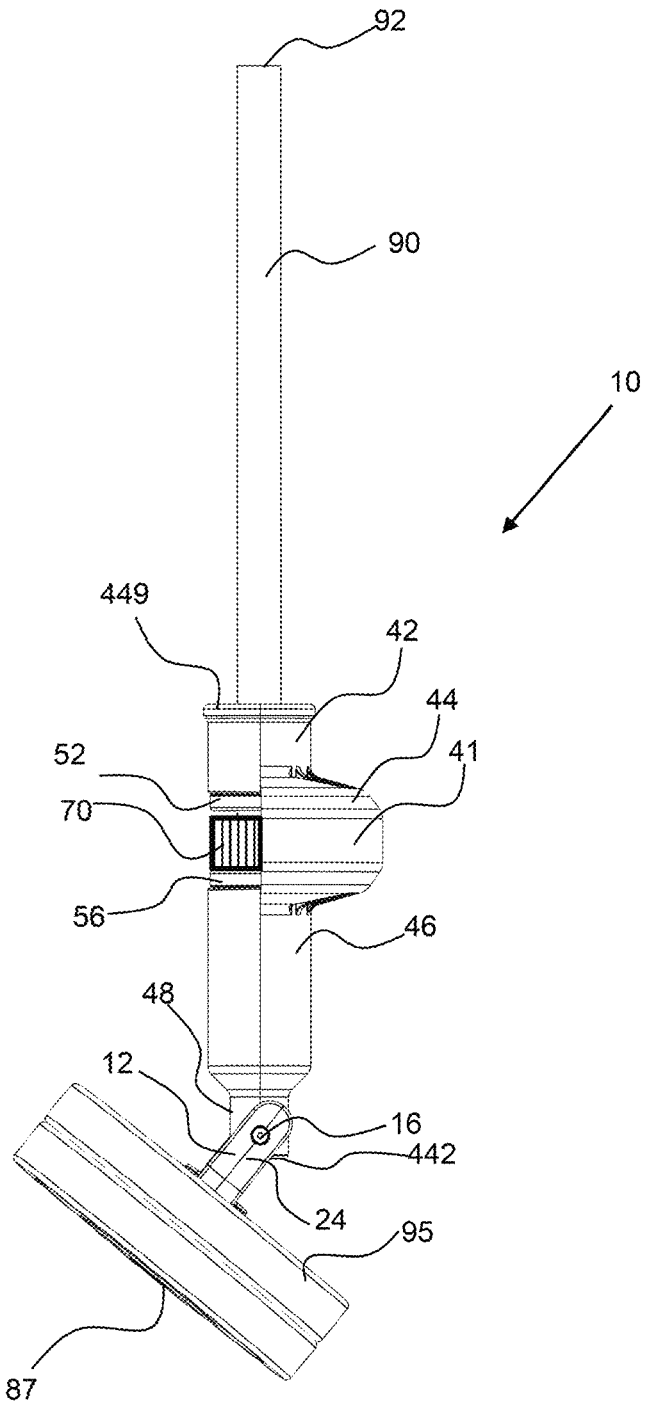
FIG. 8 shows a side view of the exercise device shown in FIG. 4, and a pole lock retained around the pole and also secured in the receiver gap between the first tube portion and the second tube portion of the pivotal tubular receiver.
Figure 10:
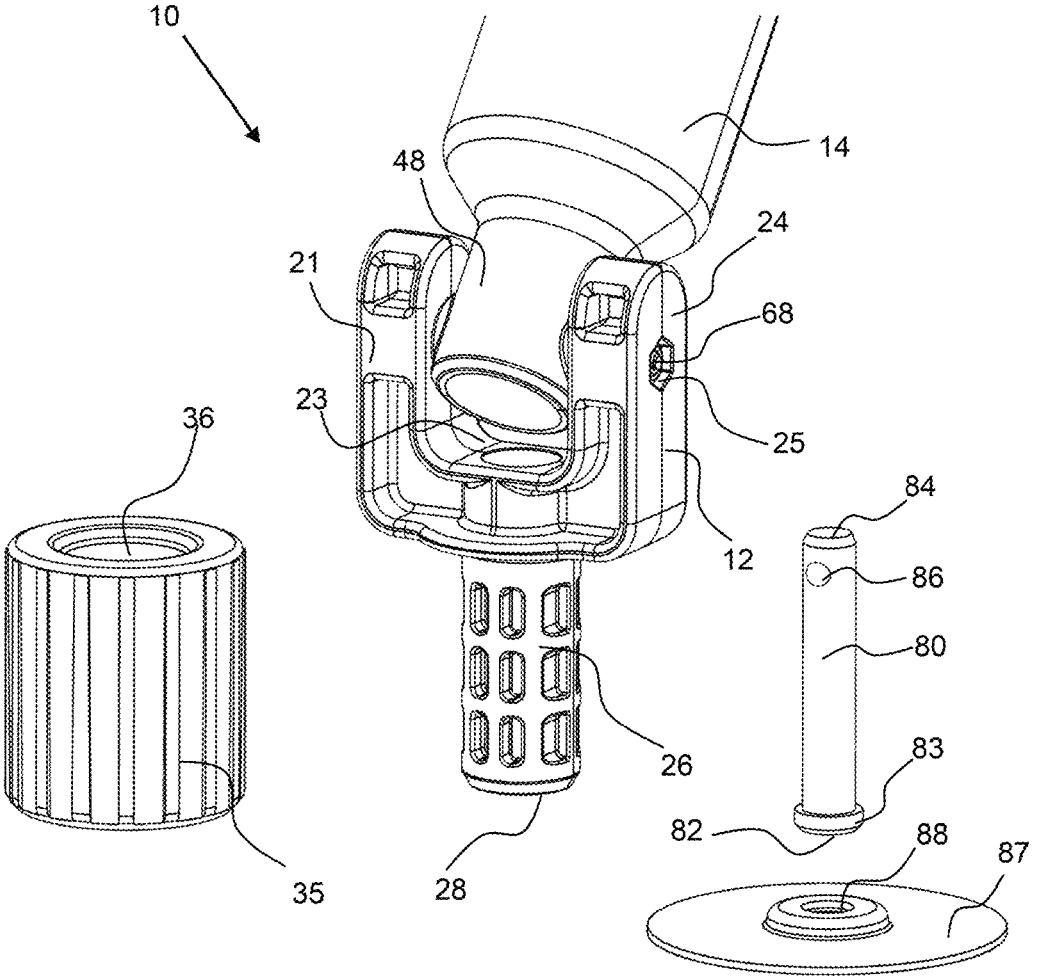
FIG. 10 shows an assembly view of a portion of the exercise device shown in FIG. 4, and particularly, the Y-shaped yoke coupled to the pivotal tubular receiver and a weight plate reducer insert, as well as the plate pin and base washer.
Figure 11:
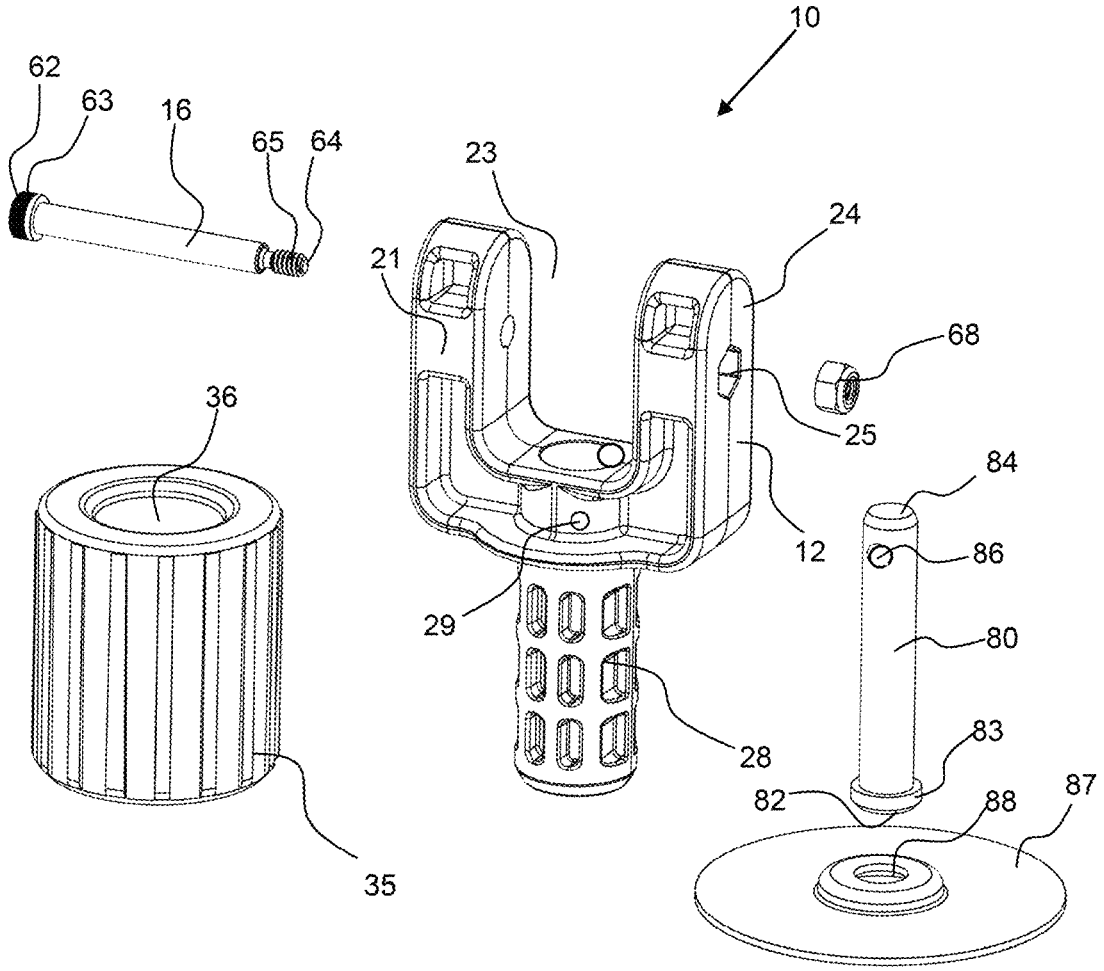
FIG. 11 shows an assembly view of a portion of the exercise device shown in FIG. 4, and particularly, the Y-shaped yoke, weight plate reducer insert, plate pin and base washer, as well as the pivot pin configured to extend through the pivot pin apertures of the first arm and second arm of the Y-shaped yoke.
Figure 12:
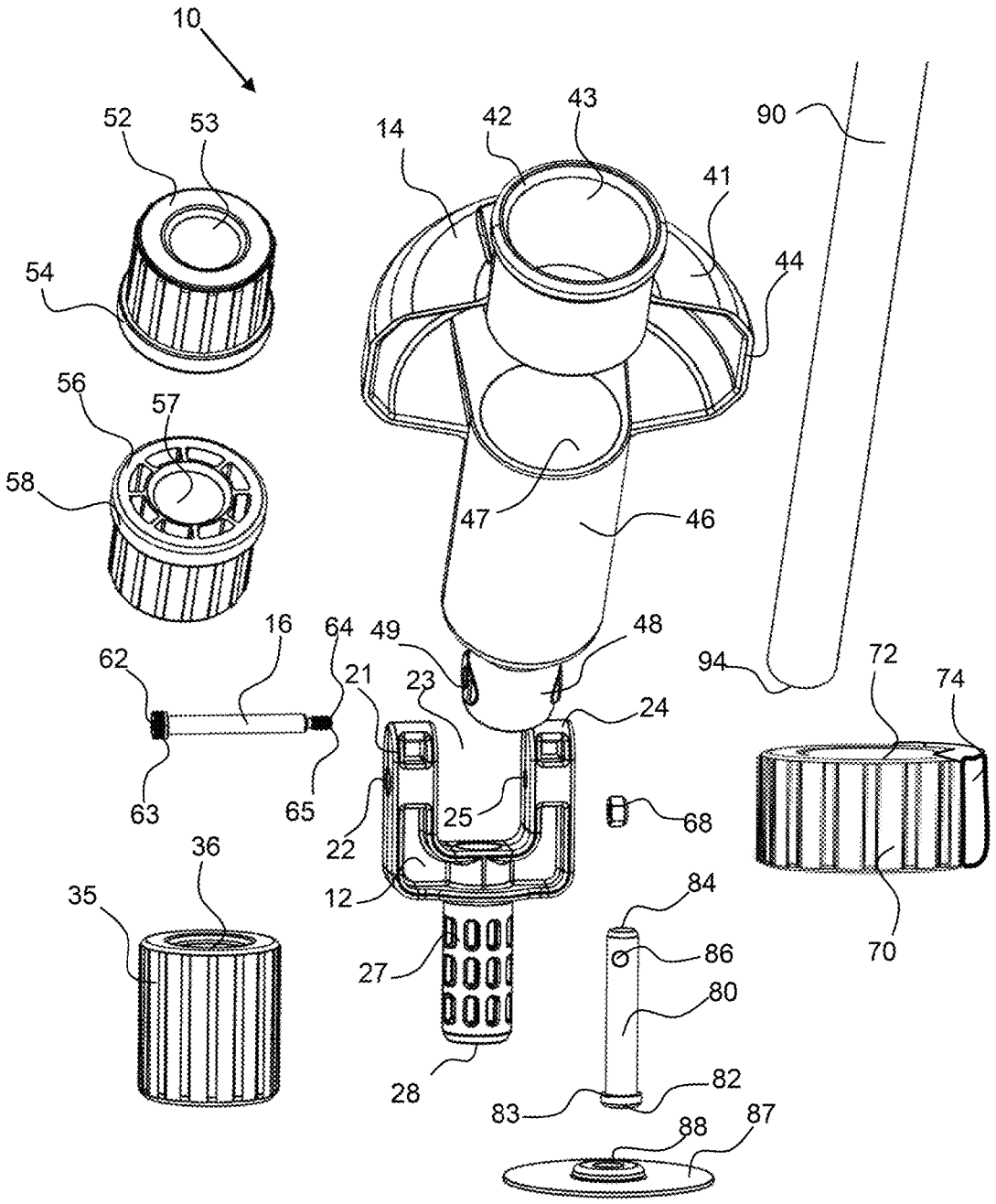
FIG. 12 shows an assembly view of the exercise device shown in FIG. 4.

Referring now to FIGS. 4 to 14, an exemplary exercise device 10 has a Y-shaped yoke 12 detachably attached to weight plates 95 and a pivotal tubular receiver 14 pivotably coupled to the Y-shaped yoke and having a pole 90 detachably attached thereto. The pivotal tubular receiver 12 is configured to receive and retain a pole 90, such as a barbell therein. The pole extends from a user end 92 to an insert end 94 that is inserted into the pivotal tubular receiver 14. The pivotal tubular receiver 14 has a first tube portion 42 having a first tube conduit 43 to receive the insert end 94 of the pole 90, and a second tube portion 46 also having a second tube conduit 47. The receiver connector 44 connects the first tube portion with the second tube portion as shown is a shroud 41 for the insertion of the pole 90 therein. A receiver gap 45 is a space or gap configured between the first tube portion 42 and the second tube portion 46 that is configured to retain a locking mechanism or pole lock 70 therein. The pole lock 70, as shown in FIG. 12, forms a pole lock conduit 72 to receive the pole therethrough and a pole locking device 74 that secures the pole lock 70 to the pole 90. As shown in FIGS. 5, 7 and 8, the pole lock 70 is capture in the receiver gap 45 between the first tube portion 42 and the second tube portion.

The pole used with the exercise device may have different diameters or dimensions and reducers may be used to accommodate the smaller dimension poles. A first tube reducer insert 52 and second tube reducer insert 56 may be configured in the first tube conduit 43 and second tube conduit 47, respectively, to provide secure engagement with a smaller dimensioned pole, as shown in FIG. 5. As shown in FIG. 12, the first tube reducer insert 52 has a first tube reducer conduit 53 and a first tube reducer flange 54 that is retained against the first tube conduit opening. As shown in FIG. 12, the second tube reducer insert 56 has a second tube reducer conduit 57 and a second tube reducer flange 58 that is retained against the second tube conduit opening.

Figure 9:
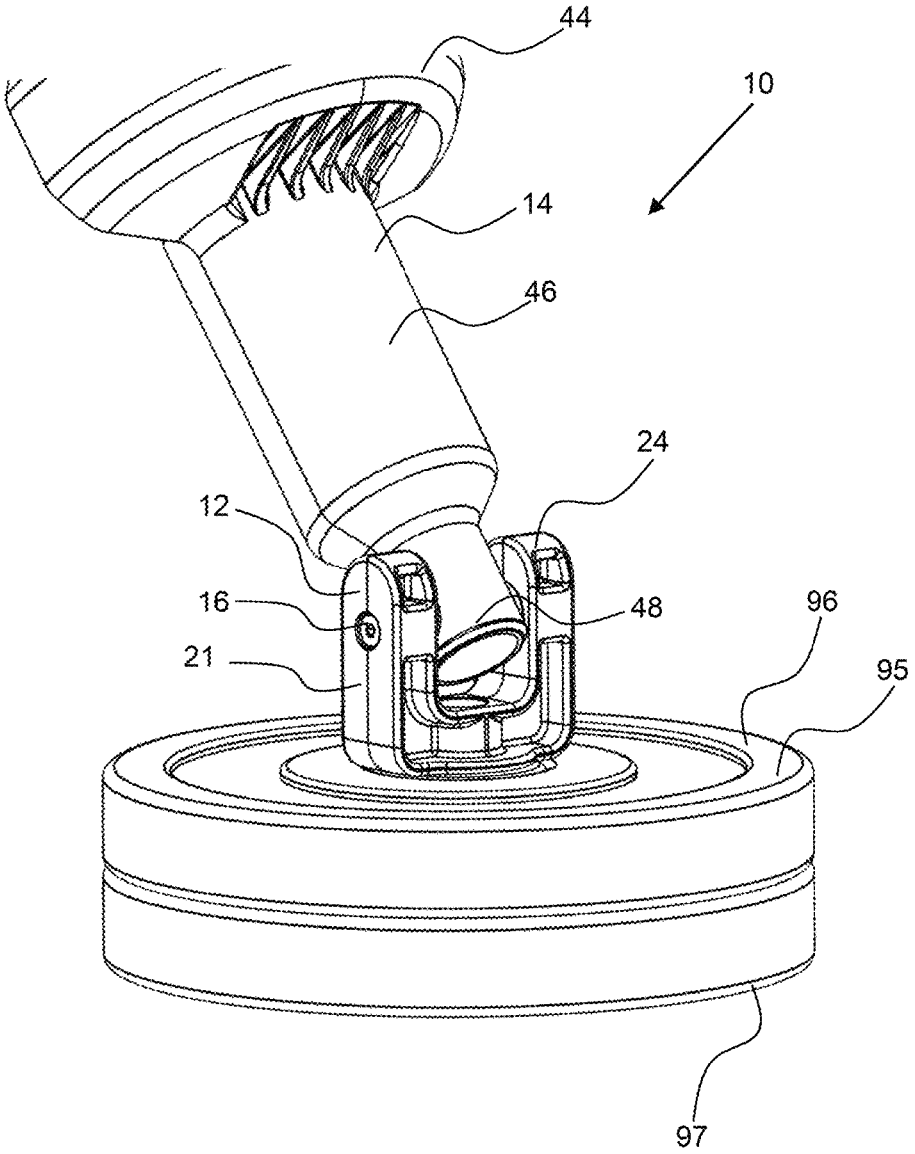
FIG. 9 shows an enlarged perspective view of a portion of the exercise device shown in FIG. 4, and particularly, the Y-shaped yoke coupled to the weight plate and the pivotal tubular receiver detachably attached thereto.

As best shown in FIGS. 9 to 11, the pivotal tubular receiver 14 has a yoke connector 48 that is a tapered portion or smaller portion of the pivotal tubular receiver 14 having a yoke connector aperture 49 for receiving the pivot pin 16 to pivotably connect the Y-shaped yoke to the pivotal tubular receiver 14. The pivot pin has a length from a first end 62 to a second end 64. A first end head 63 is secured by the first arm 21 of the Y-shaped yoke 12. The second end 64 of the pivot pin 60 may have threads 65 configured to secure a pivot pin nut 68 thereon. Also, the second arm 24 of the Y-shaped yoke 12 may have a pivot pin aperture 25 configured to receive and retain the pivot pin nut 68, such that it will not rotate. The pivot pin aperture may have planar surfaces that correspond with the planar surfaces of the pivot pin nut. The pivot pin 16 extends across the yoke gap 23, the space between the first arm 21 and second arm 23.

As shown in FIG. 9, the Y-shaped yoke 12 is detachably attachable to the weigh plate 95 or plates by the plate pin 80. The weight plate or plates has a thickness or height from the yoke side 96 to a base side 97 and a plate aperture 98 for plate extension. The shaft 27 of the Y-shaped yoke 12 has a plate extension 26 configured to extend into a plate aperture of a weight plate and a plate extension aperture 28 configured to extend down over the plate pin 80. The plate pin is configured to extend through the base washer aperture 88 in the base washer 87 with the base end head 83 of the plate pin 80 retained by the base washer 87. The plate pin extends from the base end 82 to the extended end 84 and a protrusion 86 of the plate pin 80 is configured to provide detachable engagement with the Y-shaped yoke.

Figure 13:
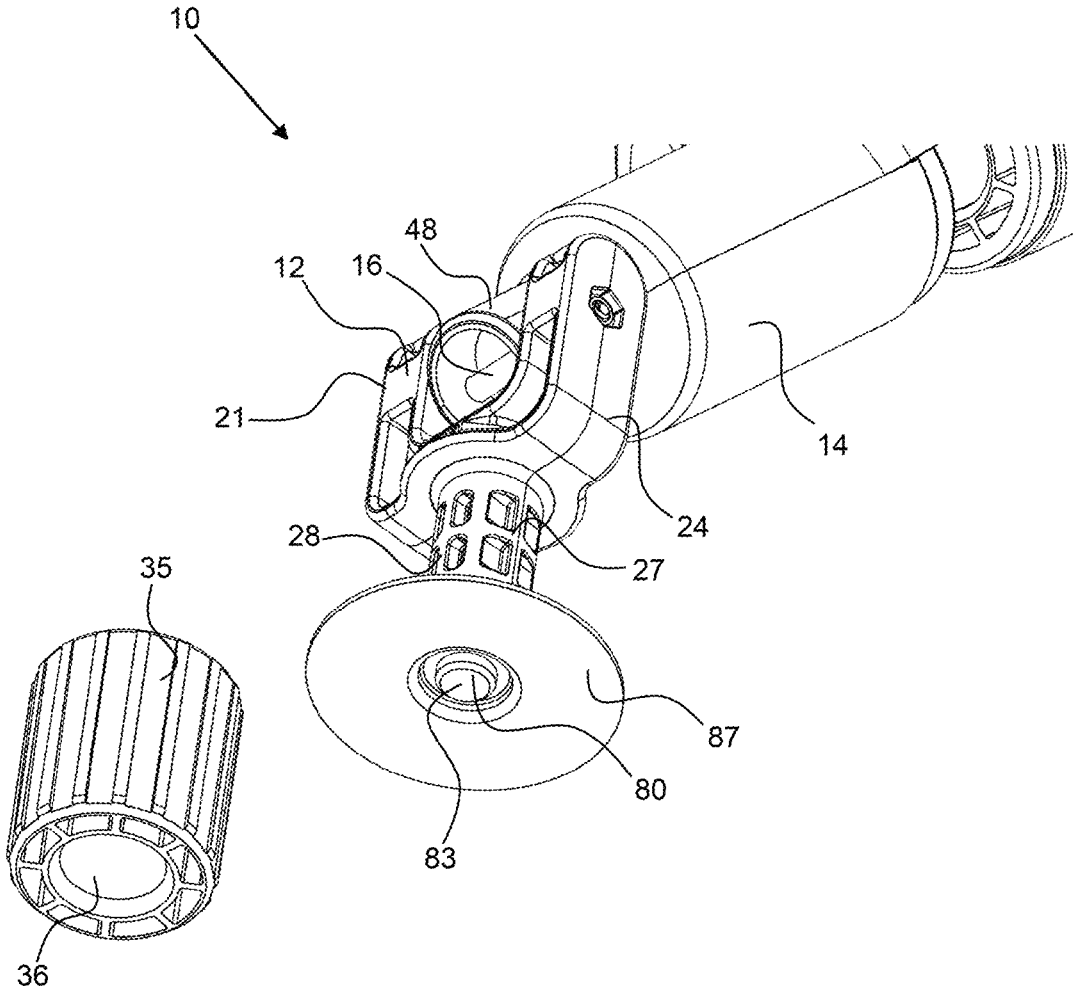
FIG. 13 shows a bottom perspective view of the plate pin extending through the base washer and the shaft of the Y-shaped yoke extending up from the base washer with the pivotal tubular receiver attached thereto.
Figure 14:
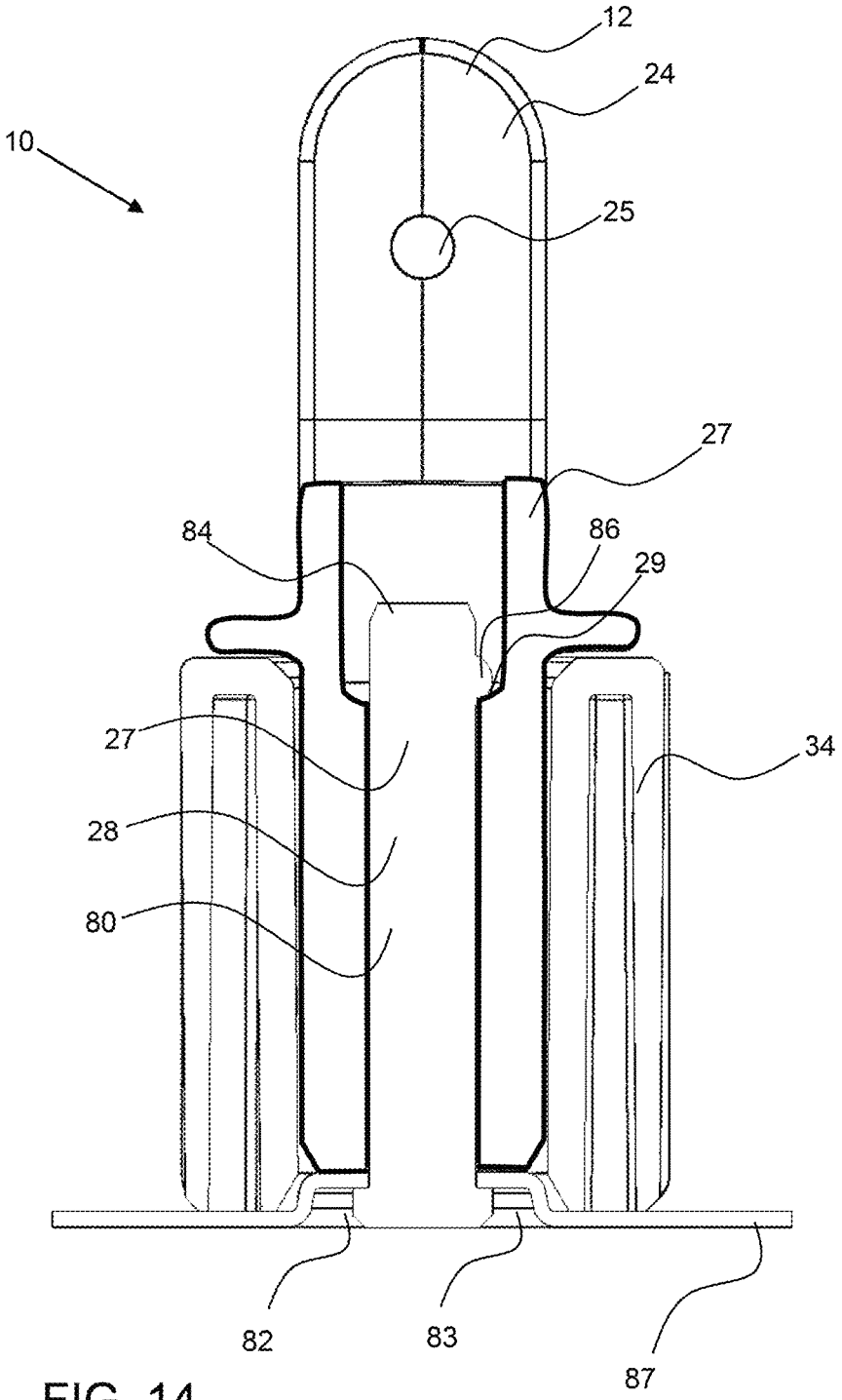
FIG. 14 shows a cross-sectional view of the Y-shaped yoke detachably attached to the plate pin by the protrusion, such as a ball, extending over the protrusion receiver of the shaft of the Y-shaped yoke.

Referring now to FIGS. 13 and 14, the shaft 27 of the Y-shaped yoke is coupled to the plate pin 80 by a protrusion 86, such as a ball, extending laterally from the side of the plate pin to extend over or into a protrusion receiver 29, which may be a flange or aperture for receiving the plate pin protrusion 86. As shown in FIG. 14, the Y-shaped yoke has a protrusion receiver 29, such as a flange to retain the ball thereon. A threshold force may be required to depress the ball into the plate pin 80 and detach the plate pin from the Y-shaped yoke.

Some weight plates may have a larger plate aperture 98 and therefore, a weight plate reducer 35 may be configured in the plate aperture to provide secure engagement with shaft 27 of the Y-shaped yoke 12. As shown in FIG. 12, the weight plate reducer 35 has a weight plate reducer conduit 36.

The pole may be lifted and rotated to provide a range of motion for exercise. A weight may be coupled to the weight pole to provide additional resistance during exercise.

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An exercise device comprising:

a y-shaped yoke comprising:

a shaft;

a first arm and a second arm forming a y-shape of said y-shaped yoke;

wherein each of the first arm and the second arm have a pivot pin aperture;

a pivotal tubular receiver comprising:

a first tube portion;

a second tube portion;

a connecting portion connecting said first tube portion and said second tube portion in an integral unit;

a yoke connector aperture;

a pivot pin extending through said yoke connector aperture in the pivotal tubular receiver and through said pivot pin aperture in each of the first arm and the second arm of the y-shaped yoke to join the pivotal tubular receiver to the y-shaped yoke;

wherein the pivotal tubular receiver is configured to pivot about the pivot pin;

a weight plate having a plate aperture; and a plate pin having a base end head, said plate pin extending through the plate aperture in said weight plate to couple the weight plate to the y-shaped yoke;

wherein the plate pin detachably attaches to the shaft of the y-shaped yoke; and wherein the y-shaped yoke is configured to rotate within the aperture of said weight plate;

whereby said weight plate provides a stabilizing support foundation while performing exercise; and wherein the first tube portion is configured to receive a pole and whereby the pole is configured to pivot the pivotal tubular receiver to perform exercise.

2. The exercise device of claim 1, wherein the connecting portion comprises a receiver gap configured between the first tube portion and second tube portion of the pivotal tubular receiver.

3. The exercise device of claim 2, further comprising a first tube receiver insert and a second tube receiver insert configured to fit within the first tube portion and second tube portion, respectively, wherein said first tube receiver insert and said second tube receiver insert are configured for insertion from the receiver gap.

4. The exercise device of claim 1, further comprising a first tube receiver insert and a second tube receiver insert configured to fit within the first tube portion and second tube portion, respectively.

5. The exercise device of claim 1, further comprising pole lock configured to couple with said pole in the connecting portion of the pivotal tubular receiver.

6. The exercise device of claim 5, wherein the connecting portion comprises a receiver gap configured between the first tube portion and second tube portion of the pivotal tubular receiver.

7. The exercise device of claim 6, wherein the connecting portion is a shroud that extends about 270 degrees or less about a length axis of the pivotal tubular receiver.

8. The exercise device of claim 7, wherein the shroud has a larger inner diameter than either of the first tube portion or second tube portion.

9. The exercise device of claim 8, wherein the inner diameter of the shroud is at least twice that of the first tube portion.

10. The exercise device of claim 1, further comprising a weight plate reducer configured for insertion into the aperture in the weight plate.

11. The exercise device of claim 1, wherein the pivotal tubular receiver further comprises a yoke connector that is smaller in diameter than the second tube portion and comprises said yoke connector aperture.

12. The exercise device of claim 1, wherein the second tube portion has a second tube conduit configured to receive said pole.

13. The exercise device of claim 1, wherein the second tube portion has a second tube conduit configured to receive said pole.

14. The exercise device of claim 1, wherein the pivot pin is a bolt having threads on a second end.

15. The exercise device of claim 14, further comprising a nut, and wherein the yoke is joined to the pivotal tubular receiver by said nut configured on the bolt.

16. The exercise device of claim 15, wherein the pivot pin aperture in the second arm comprises a recess for receiving and retaining the nut.

17. The exercise device of claim 16, wherein the nut is a locking nut.

18. The exercise device of claim 17, wherein the bolt has a bolt head and wherein the pivot pin aperture in the first arm comprises a recess for receiving and retaining the bolt head.

* * * * *